US007946522B2

(12) United States Patent
Lewis et al.

(10) Patent No.: US 7,946,522 B2
(45) Date of Patent: May 24, 2011

(54) SYSTEM AND METHOD FOR DISSIPATING STATIC ELECTRICITY IN AN ELECTRONIC SHEET MATERIAL DISPENSER

(75) Inventors: Richard P. Lewis, Marietta, GA (US); Paul Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 508 days.

(21) Appl. No.: 11/589,684

(22) Filed: Oct. 30, 2006

(65) Prior Publication Data

US 2008/0099595 A1 May 1, 2008

(51) Int. Cl.
*B65H 16/10* (2006.01)

(52) U.S. Cl. ..... 242/564.1; 242/563; 242/565

(58) Field of Classification Search ..... 242/564, 242/564.1, 565, 563
See application file for complete search history.

(56) References Cited

U.S. PATENT DOCUMENTS

| | | | | |
|---|---|---|---|---|
| 3,594,611 | A | 7/1971 | Tanner et al. | |
| 4,549,664 | A * | 10/1985 | Gowan et al. | 211/131.1 |
| 4,570,197 | A | 2/1986 | Hakanson et al. | |
| 4,715,086 | A | 12/1987 | Johanson et al. | |
| 4,981,544 | A | 1/1991 | Nordale | |
| 5,262,229 | A * | 11/1993 | Lampert et al. | 428/220 |
| 5,491,013 | A | 2/1996 | Holley | |
| 5,740,006 | A * | 4/1998 | Larkin | 361/213 |
| 6,152,445 | A * | 11/2000 | Hirota et al. | 271/315 |
| 6,647,242 | B2 | 11/2003 | Gagnon et al. | |
| 6,871,815 | B2 | 3/2005 | Moody et al. | |
| 6,915,977 | B2 | 7/2005 | Hanzlik et al. | |
| 6,952,555 | B2 | 10/2005 | Oh et al. | |
| 6,974,783 | B2 | 12/2005 | Akdogan et al. | |
| 7,017,856 | B2 * | 3/2006 | Moody et al. | 242/564.4 |
| 7,022,764 | B2 | 4/2006 | Murray | |
| 7,070,203 | B2 | 7/2006 | Fisher et al. | |
| 7,182,289 | B2 * | 2/2007 | Moody et al. | 242/564.4 |
| 2002/0109034 | A1 | 8/2002 | Moody et al. | |
| 2004/0178297 | A1 | 9/2004 | Moody et al. | |
| 2005/0018375 | A1 | 1/2005 | Takayanagi | |

FOREIGN PATENT DOCUMENTS

| | | | |
|---|---|---|---|
| DE | 2 227 249 | | 6/1972 |
| EP | 0412169 | B1 | 11/1994 |
| EP | 0695114 | B1 | 1/1996 |
| EP | 0 924 573 | | 6/1999 |
| EP | 924573 | A1 * | 6/1999 |
| EP | 1230886 | B1 | 8/2002 |
| EP | 1231823 | B1 | 8/2002 |
| EP | 1336368 | A2 | 8/2003 |
| EP | 1659691 | A2 | 5/2006 |
| WO | 2006/011419 | A1 | 2/2006 |

OTHER PUBLICATIONS

Patent Abstract of Japan No. 09245987 A—Sep. 19, 1997.
Patent Abstract of Japan No. 2003347098 A—Dec. 5, 2003.
Patent Abstract of Japan No. 2004087365 A—Mar. 18, 2004.
Staticfaction, Inc.—Thunderon Conductive (Adhesive Tape)—Oct. 16, 2006.
Staticfaction, Inc.—Thunderon Tape Brush Self-Discharging Static Remover—Oct. 16, 2006.
Co-Pending U.S. Appl. No. 11/589,682, filed Oct. 30, 2006.
Search Report, Jan. 30, 2008.
May 3, 2011 Correspondence from John J. Timar, Esquire, Womble Carlyle Sandridge & Rice to Ralph H. Dean, Jr., Patent Counsel, Kimberly-Clark Corporation.

* cited by examiner

*Primary Examiner* — Michael R Mansen
*Assistant Examiner* — Juan J Campos
(74) *Attorney, Agent, or Firm* — Dority & Manning, P.A.

(57) ABSTRACT

An electronic dispenser for dispensing a measured sheet from a roll of web material includes a passive, self-discharging static charge dissipating material configured with at least one component of the dispenser that stores static charge generated by operation of the dispenser.

10 Claims, 5 Drawing Sheets

SYSTEM AND METHOD FOR DISSIPATING STATIC ELECTRICITY IN AN ELECTRONIC SHEET MATERIAL DISPENSER

FIELD OF THE INVENTION

The present invention relates generally to the field of electronic dispensers for dispensing lengths of sheet material, such as towel or tissue material, from a roll, and more particularly to a system and method for dissipating static electricity generated in such dispensers.

BACKGROUND

Electronic sheet material dispensers are well know in the art, including dispensers that automatically dispense a metered length of towel or tissue material upon sensing the presence of a user. This type of dispenser has become known in the art as a "hands-free" dispenser in that it is not necessary for the user to manually actuate or otherwise handle the dispenser to initiate a dispense cycle. The control systems and mechanical aspects of conventional hands-free dispensers are wide and varied.

A common problem associated with conventional electronic dispensers is the buildup and discharge of static electricity generated during the dispense cycle. A static charge may be generated in the dispenser from any number of components or operations, such as the movement of the paper web over various rollers or other guide structure, interaction between guide rollers, and so forth. The static charge can be relatively small, or may be up to about thirty or more kilovolts. If not grounded or dissipated, this charge may result in the user receiving an unpleasant "static shock" when using the dispenser. The charge may also be detrimental to the dispenser's electronic control circuitry, particularly the relatively sensitive sensor circuitry.

Efforts have been made in the past to ground the charge-generating components of the dispenser, such as the drive roller, to a ground surface within or external to the dispenser. Other methods include grounding components through a ground connection of the electronic circuitry. These methods, however, require a readily accessible ground, such as an existing ground connection of a conventional AC power supply system, a grounded plumbing component, a dedicated grounding rod, or the like. Unfortunately, it is often the case that battery-powered electronic sheet material dispensers are not located in close proximity to a readily accessible ground connection. For example, the wall of a public restroom, or the walls of a toilet enclosure in the case of a toilet tissue dispenser, may not provide an accessible ground connection. In this situation other measures are necessary.

U.S. Pat. Nos. 6,871,815 and 7,017,856 propose a system wherein a low impedance, high-conductivity pathway (i.e., a wire) is used to connect internal components of the dispenser that are subject to static charge buildup to a mechanical contact on the back of the dispenser housing. This contact, in turn, makes contact with the supporting wall upon which the dispenser is mounted, with the premise being that any static charge will be dissipated by the wall.

The art is thus constantly seeking ways to improve upon conventional electronic sheet material dispensers, and the present disclosure relates to an alternative unique system and method for dissipating static charge buildup in such dispensers.

SUMMARY

Objects and advantages of the invention will be set forth in part in the following description, or may be obvious from the description, or may be learned through practice of the invention.

An electronic sheet material dispenser is provided for dispensing a measured sheet of web material, such as towel or toilet tissue material. It should be appreciated by those skilled in the art that the present invention is not limited to any particular type of electronic sheet material dispenser, and has utility for any dispenser wherein it is desired to dissipate static charge build-up. The dispenser may be a "hands-free" dispenser that is automatically actuated upon detection of an object placed within a defined detection zone. In alternative embodiments, the dispenser may be actuated upon the user pressing a button, switch, or other manual actuating device to initiate a dispense cycle. The dispenser may be battery powered, AC powered (with an appropriate transformer and adapter), or capable of being switched between battery power and AC power.

The dispenser includes a housing having an internal volume so as to retain at least one roll of web material therein, for example a roll of towel or toilet tissue material. In a particular embodiment, the housing is configured to retain a primary reserve roll and a depleted stub roll, with an automatic transfer mechanism to automatically switch to the primary roll once the stub roll is depleted. The housing may take on any desirable and aesthetically pleasing configuration, and may include a back member and removable cover member. The cover member may be hinged relative to the back member to provide access to the interior volume and components of the dispenser.

The dispenser includes an electronically powered dispensing mechanism contained within the housing for dispensing a measured sheet from the roll of web material, for example upon a valid detection of an object in a detection zone. Numerous configurations of electrically driven dispensing mechanisms are known in the art and may be configured for use with the present dispenser. In a particular embodiment, a separate chassis or module is received in the housing, the module having the dispensing mechanism mounted therein. The mechanism may include a drive roller and associated components, a pressure roll assembly, and a tear bar or other suitable cutting mechanism. The pressure roll assembly typically includes a pressure roll biased by springs against the drive roller, with the web material passing between the pressure roll and drive roller. An opening for the towel material is defined in the module and aligns with a dispensing opening in the housing.

In an embodiment wherein the dispenser dispenses from a stub roll and subsequently from a reserve or "main" roll, the chassis may include main roll holders and stub roll holders for rotatably supporting the respective rolls in a position within the module for unobstructed dispensing therefrom. As mentioned, an automatic transfer mechanism can be provided to transfer dispensed towel material from the stub roll to the main roll when the stub roll is nearly fully depleted.

A roll-size ("fuel") gauge may be configured in the module to indicate to service or maintenance personnel when the main roll has been depleted a sufficient amount to be moved to the stub roll position. This gauge may be a member that is biased against the outer circumferential surface of the main roll such that it tracks with the decreasing diameter of the main roll as the web material is depleted. When the main roll reaches a certain depleted diameter, the gauge may activate a switch causing an LED to light, or other indicator, to indicate that the main roll is depleted and should be replaced. Alternatively, the indicator may be a mechanical type, such as a flag that becomes visible upon the diameter of the main roll being sufficiently reduced.

The dispensing mechanism dispenses a measured length or sheet of the web material, which may be accomplished by various means, such as a timing circuit that stops the drive roller after a predetermined time. In a particular embodiment, a revolution counter is provided that measures the degree of rotation of the drive roller and is interfaced with control circuitry to stop a drive roller motor after a defined number of revolutions of the roller. This counter may be an optical encoder type of device, or a mechanical device. The control circuitry may include a device to allow maintenance personnel to adjust the sheet length by increasing or decreasing the revolution counter set point.

The drive mechanism may include a drive motor and gear assembly mounted in the module, the gear assembly transmitting motive force from the motor to the drive roller. The web material passes through the nip defined by the drive roller and pressure roller such that rotation of the drive roller causes the material to be advanced out through the dispensing throat of the housing. A tear bar is disposed in the throat so that a user can separate a sheet of the material by grasping and pulling the sheet across the tear bar. In an alternative embodiment, an automatic cutting device may be provided to automatically cut the sheet of material.

In the case of an automatic dispenser, a sensor may be provided to detect an object placed in a detection zone external to the dispenser. This sensor may be a passive sensor that detects changes in ambient conditions, such as ambient light, capacitance changes caused by an object in a detection zone, and so forth. In an alternate embodiment, the sensor is an active device and includes an active transmitter and associated receiver, such as one or more IR transmitters and IR receiver. The transmitter transmits an active signal in a transmission cone corresponding to the detection zone, and the receiver detects a threshold amount of the active signal reflected from an object placed into the detection zone. Control circuitry is configured with the sensor for initiating a dispense cycle upon a valid detection signal from the receiver.

A passive, self-discharging static charge dissipating material is incorporated with at least one internal component of the dispenser that is prone to generating and storing static charge upon operation of the dispenser. The component may be any one or combination of elements that are susceptible to generating or storing static charge. For example, the component may be the shaft or surface of the drive roller or pressure roller, or the tear bar against which the web material is pulled in order to separate a sheet of the material. The component may be a guide surface against which the web material is conveyed, such as a portion of the dispenser throat. In an alternative embodiment, the component may be a surface that contacts the roll of web material, such as a surface against which the roll rests, or the fuel gauge bar that is biased against the roll of web material.

The static charge dissipating material may be incorporated with the component in various ways. For example, the material may be a tape, film, coating, or other material that is applied to an outer surface of the component at any desired location. Examples of such materials are discussed below. In other embodiments, the static discharge material may be an integral part of the component. For example, the material may be formed directly with the component, embedded in the component, or the like. In a particular embodiment, the component is a molded polymer component, such as a portion of the housing or module, a roll, a web guide surface, or the like, and the static charge dissipating material is an antistatic additive added to the polymer composition used to form the component.

The static charge dissipating material may be incorporated with a single component, or with a plurality of different components within the internal volume of said housing. In particular embodiments, the material is incorporated with one or more components along which the web material runs in its conveying path through the dispenser. For example, the material may be provided along a portion of the dispensing throat, around a portion of the pressure roller or drive roller, and configured with the tear bar.

It should be appreciated that the dispenser is not limited to any particular style, configuration, or intended type of web material. For example, the dispenser may be a towel dispenser, toilet tissue dispenser, or any other sheet material dispenser.

Various methods for dissipating static charge build-up in electronic sheet material dispensers through utilization of a passive charge dissipating material are also within the scope and spirit of the invention, and include incorporating a passive, self-discharging static charge dissipating material with at least one component within the dispenser that stores static charge generated from operation of said dispenser as discussed above.

Aspects of the invention will be described in greater detail below by reference to particular embodiments illustrated in the drawings.

DETAILED DESCRIPTION

Figure 1:
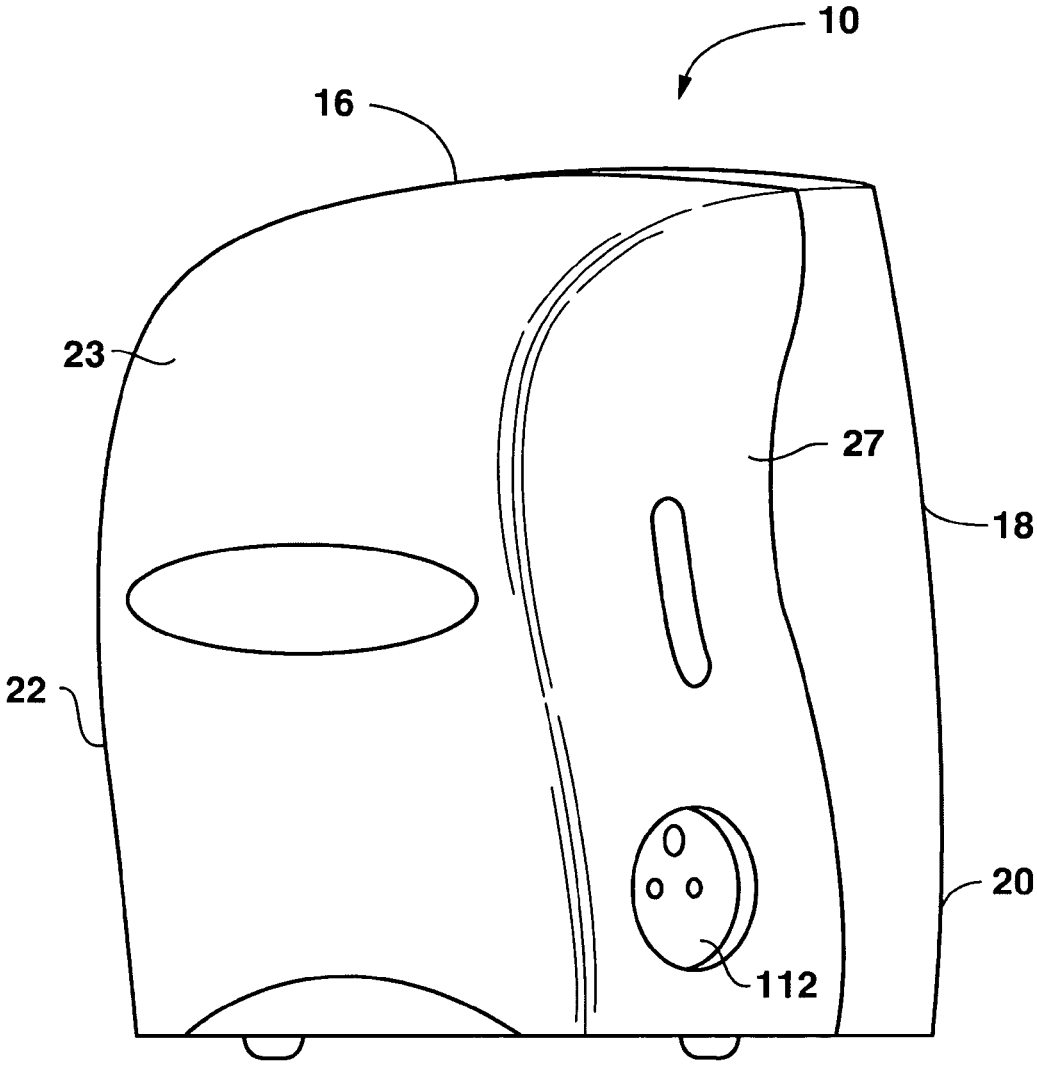
FIG. 1 is a perspective view of an embodiment of an electronic dispenser according to the invention.

Reference will now be made in detail to embodiments of the invention, one or more examples of which are illustrated in the drawings. Each example is provided by way of explanation of the invention, and not meant as a limitation of the invention. For example, features illustrated or described as part of one embodiment, may be used with another embodiment, to yield still a further embodiment. It is intended that the present invention include modifications and variations to the embodiments described herein.

Figure 2:
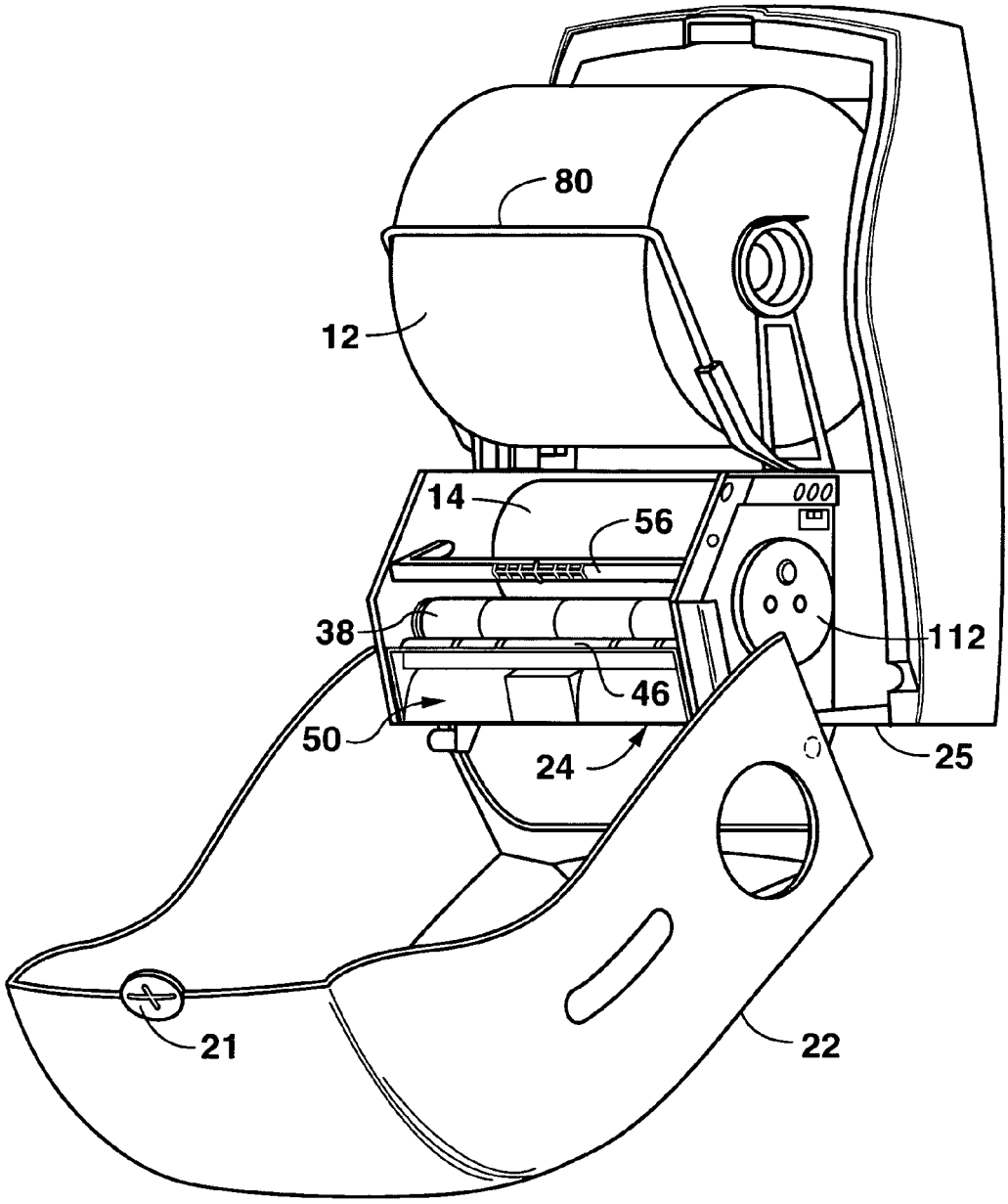
FIG. 2 is a perspective view of the dispenser of FIG. 1 with the front cover in its open position.
Figure 3:
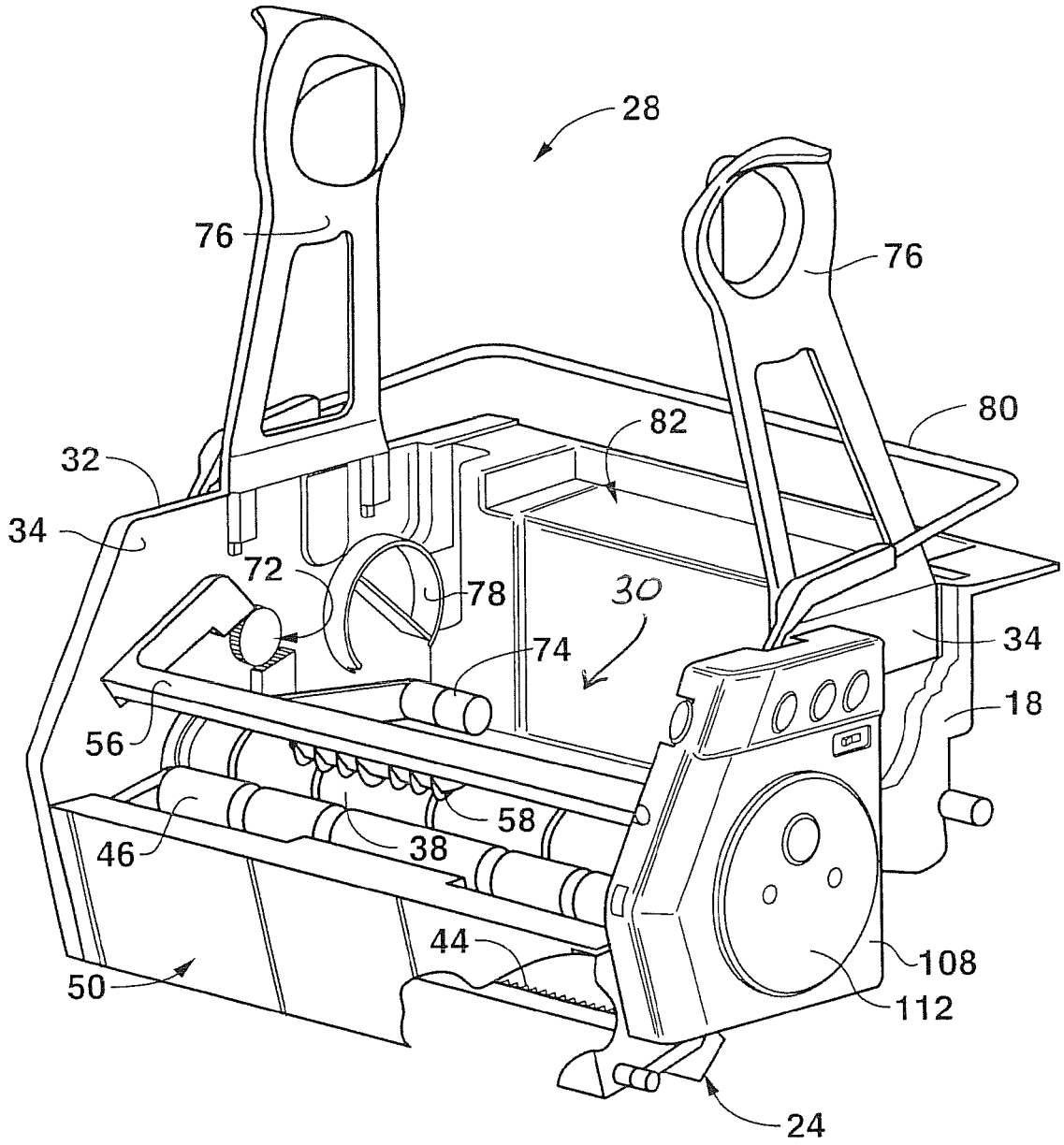
FIG. 3 is a perspective view of a removable module unit that may be utilized with the dispenser of FIG. 1.

Referring particularly to FIGS. 1 through 3, an embodiment of a dispenser 10 according to the invention is illustrated. The dispenser 10 includes a housing 16 of any desired shape and configuration. The housing 16 includes a base 18 and a cover 22 pivotally mounted on the base 18 so as to be movable from the closed position illustrated in FIG. 1 to the open position illustrated in FIG. 2. The cover 22 includes a front wall 23 and sidewalls 27 that align with sidewalls 20 of the base 18 to define an interior volume for housing the operational components of the dispenser 10, as well as the roll or rolls of web material to be dispensed, including a main roll 12 and a stub roll 14. Any conventional locking mechanism 21 (FIG. 2) may be provided to secure the cover 22 to the base 18. The housing 16 includes a bottom underside portion 25 with a throat (not visible) from which the material is dispensed.

The dispenser configuration 10 illustrated in FIGS. 1 and 2 is merely exemplary of any number of electronic dispenser configurations that may incorporate the static charge dissipation system and method in accordance with the invention. As such, a detailed explanation of the structural and control features of the dispenser 10 are not necessary for purposes of explanation of the static charge dissipating system and method of the invention, and will only be discussed briefly below.

The operational components of the dispenser 10 may be mounted directly onto the base 18 within the interior volume of the housing 16. In an alternative embodiment, a dispensing module 28 (FIG. 3) is received in the housing 16, as seen in FIG. 2, and the operational components are mounted within the module 28. The module 28 may be readily removable from the base 18 for servicing and/or replacing components without the necessity of having to remove the entire dispenser 10 from its support surface (i.e., wall). The housing 16 may be considered as a shell into which the module 28 of FIG. 3 is inserted and removed. The module 28 includes a frame or chassis 32 having left and right side plates 34. Within the module 28 between the side plates 34 are mounted the components of the dispensing mechanism 30, which may include, for example, a pressure roller assembly with a pressure roller 46, a transfer mechanism that may include a transfer arm 56, a throat assembly 50 that defines the throat 24 and includes a tear bar 44, a drive motor and gear assembly (not visible) that rotates drive roller 38, and control circuitry housed within a circuit housing 108.

Figure 4:
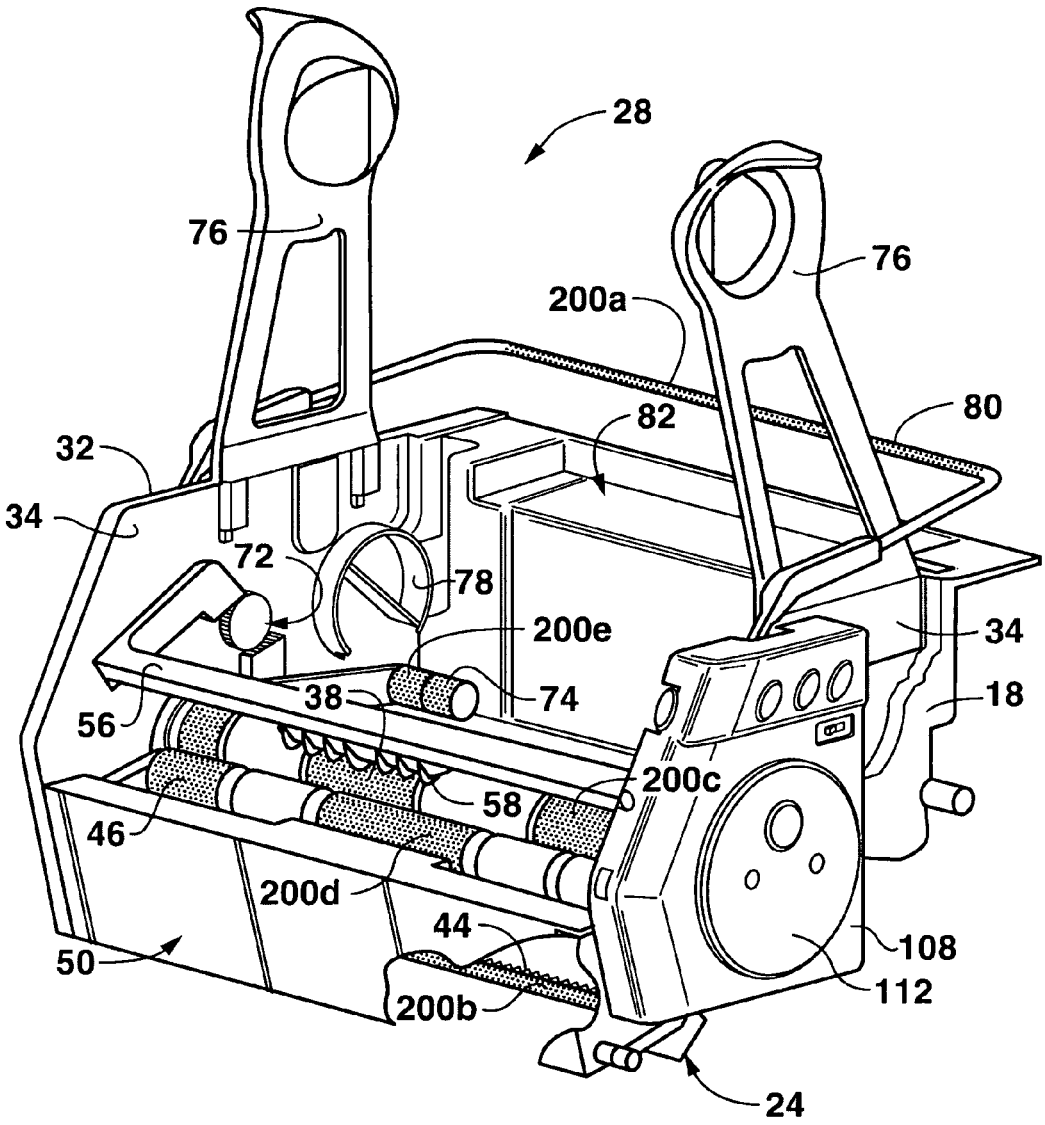
FIG. 4 is a perspective view of an embodiment of a dispenser module illustrating the use of static charge dissipating material incorporated with various components thereof.

Left and right main roll holders 76 are attached to the module side plates 34, as seen in FIG. 4, and hold the main roll 12 of sheet material. Stub roll holders 78 are provided for rotatably supporting the stub roll 14 in the position within the module below and rearward of the main roll 12. It should be understood that a dispenser according to the invention need not be configured to dispense from a stub roll, and thus would not need a transfer mechanism. The dispenser may be configured for dispensing from a single roll of web material.

The pressure roller assembly with pressure roller 46 may be housed in the throat assembly 50 that is, in turn, mounted within the module 28. The throat assembly 50 includes a frame that may be fixed in position within the module, or pivotally mounted to the module 28 to facilitate loading of new rolls of web material. The cutting or "tear" bar 44 within the throat assembly 50 is disposed along the dispensing path of the web material upstream of the dispensing opening 24 and downstream of the nip between a drive roller 38 and pressure roller 46. To separate a sheet of the web material that has been dispensed from the dispenser 10, a user grasps the sheet hanging from beneath the bottom portion 25 of the housing 16 and pulls the sheet against the tear bar 44 such that the sheet tears and separates along the line defined by the tear bar 44.

The pressure roller 46 is spring biased against the drive roller 38 such that the web material passing between the nip of the rollers is advanced along the dispensing path upon rotation of the drive roller 38. The throat assembly 50 defines a portion of the dispensing path and the forward portion of the dispensing throat 24.

The module 28 may include an automatic transfer mechanism to transfer dispensing of the web material from the stub roll 14 to a main roll 12 when the web material on the stub roll 14 is nearly fully depleted. From an operational standpoint, this transfer mechanism can operate substantially as described in U.S. Pat. No. 6,079,305 issued on Jun. 27, 2000, with the '305 patent incorporated herein in its entirety for all purposes. Referring to FIGS. 2 and 3, the transfer mechanism may include a transfer bar 56 with arms pivotally mounted to the module side plates 34 through gearing 72. The transfer bar 56 includes a "roller" section that may be defined by a central curved ribbed section 58. The section 58 includes a securing mechanism, such as a barb, so that the leading end of the web material from the main roll 12 passes over the roller section 58 and is held by the barb while material is feed from the stub roll 14. A stub roll sensing bar 74 is pivotally mounted to the module side plates 34 below stub roll holders 78, and is biased towards the axis of the stub roll holders 78 so as to track the decreasing diameter of the stub roll as it is depleted. The stub roll sensing bar 74 is configured with the gearing 72 that rotates upon pivotal movement of the sensing bar 74. As the stub roll is depleted, motion of the sensing bar 74 is transferred to the transfer bar 56 via the gearing 72. At a certain decreased diameter of the stub roll 14, the transfer bar 56 rotates to a position such that the leading end of the web material held by the bar 56 is brought by the roller section 58 into contact with the web material being dispensed from the stub roll causing the leading edge of the material from the main roll to be pulled from the arm 56 and conveyed with the material from the stub roll between the nip of the drive roller 38 and pressure roller 46. The "new" web material from the main roll 12 is dispensed simultaneously with the stub roll material until the stub roll is completely depleted. If no stub roll is present in the dispenser, the transfer bar 56 and roller section 58 contact against the web material dispensed from the main roll 12.

A spring biased "fuel gauge" bar 80 may be pivotally affixed to the side plates 34 and biased towards the center of the main roll 12 such that it tracks with the decreasing diameter of the main roll 12 as the web material is depleted. The bar may be biased from the front side of the roll, or from any other location against the circumference of the roll 12. When the main roll 12 reaches a diameter suitable for moving the roll to the stub roll position, a pawl (not visible) on the end of one of the arms of the bar 80 causes a switch in the control circuitry to close and activate an LED on the indicator plate 112. In this way, maintenance personnel are alerted that the main roll 12 is depleted and should be replaced.

A drive motor and gear assembly includes components mounted in the module 28, for example in a space under and behind the drive roller 38. The motor includes a drive shaft and a drive gear attached thereto that engages the shaft of the drive roller 38. Thus, upon energizing the motor, the drive roller 38 is caused to rotate, which results in conveyance of the web material disposed in the nip between the pressure roller 46 and drive roller 38 along the conveying path and out of the dispensing throat 24.

The dispensing mechanism may be powered by batteries contained in battery compartment 82 that is rearward of the stub roll holders 78 (see FIG. 3). Any suitable battery storage device may be used for this purpose. A conductor may be disposed below the battery compartment that mates with contacts on the underside of the battery compartment 82 for delivering power from the batteries to the circuitry in housing 108 and the drive motor. Alternatively, or in addition to battery power, the dispenser may also be powered by a building's AC distribution system. For this purpose, a plug-in modular transformer/adapter may be provided with the dispenser, which connects to a terminal or power jack port located, for example, in the bottom edge of the circuit housing 108 for delivering power to the control circuitry and associated components. The control circuitry may include a mechanical or electrical switch that isolates the battery circuit upon connecting the AC adapter in order to protect and preserve the batteries.

The dispenser control circuitry controls activation of the dispensing mechanism upon valid detection of a user for dispensing a metered length of the sheet material. Sensors and associated circuitry may be provided for this purpose. Various types of sensors are well known to those skilled in the art, including infrared (IR), radio frequency (RF), capacitive sensors, and so forth. Any one or combination of such sensing systems may be used. A detailed explanation of the sensing system is not necessary for purposes of the present disclosure. In the embodiment of the dispenser 10 illustrated in the figures, an IR sensing system may be used to detect the presence of a user's hands placed below the bottom portion 25 of the housing 16.

The control circuitry also controls the length of web material dispensed. Any number of optical or mechanical devices may be used in this regard. In the illustrated embodiment of the dispenser 10, an optical encoder may be used to count the revolutions of the drive roller 38, with this count is used by the control circuitry to meter the desired length of the sheet to be dispensed. Other systems may track the running time of the motor as the control variable, or detect perforations in the web material, and so forth.

Figure 5:
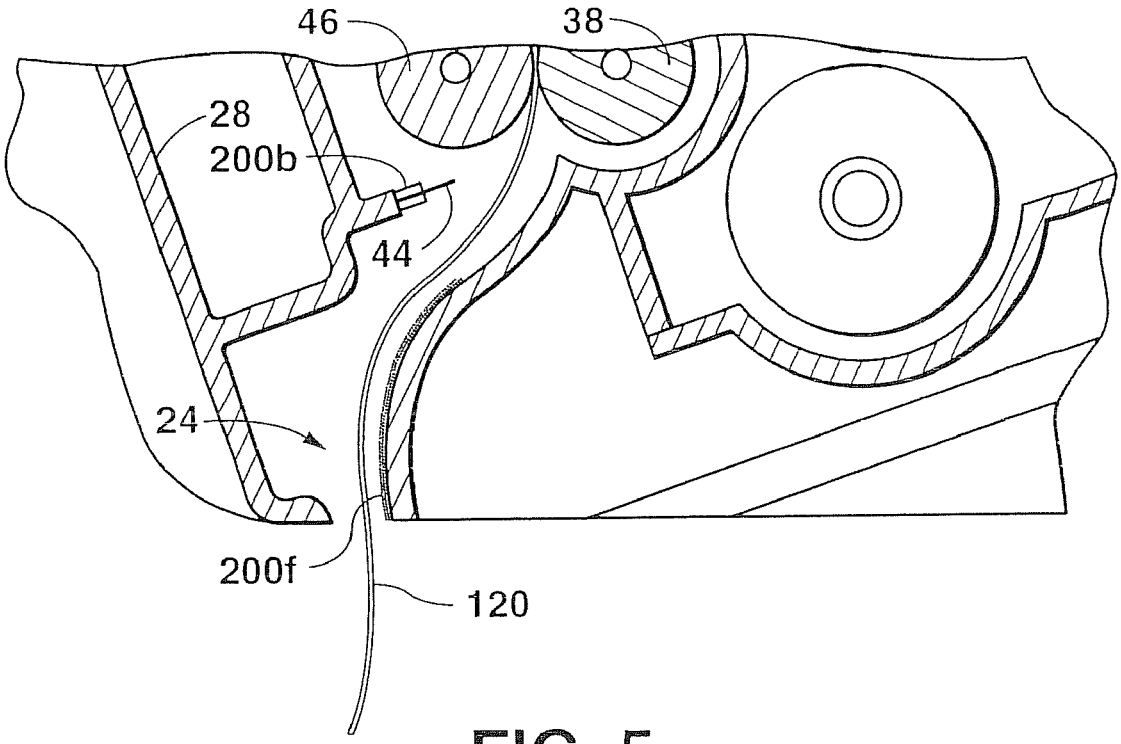
FIG. 5 is a partial cut-away view of a throat section of a dispenser incorporating static charge dissipating material along a surface thereof.

Aspects of the static charge dissipation system and method are described with reference to FIGS. 4 through 6. Referring to FIG. 4 in particular, a passive static charge dissipating material is depicted as incorporated with various components of the dispenser 10. For example, material 200*a* is associated with the fuel gauge bar 80 that is biased against the main roll 12 (FIG. 2). Material 200*b* is configured with the tear bar 44, and may be applied directly to the bar 44 or to a holder that retains the bar 44. Material 200*c* is configured with the drive roller 38, and may be applied to portions of the circumference of the roller 38 or over the entire surface of the roller. Material 200*d* is configured with the pressure roller 46, and may be applied to portions of the circumference of the roller 46 or over the entire surface of the roller. Material 200*e* is associated with the stub roll sensing bar 74 that is biased against the stub roll 14 in use of the dispenser. It should be appreciated that the static charge dissipating material may be applied to any one or combination of components within the dispenser 10.

The passive, self-discharging static charge material may be any one or combination of commercially available materials specifically designed to dissipate static charge from charged bodies. Suitable materials are available, for example, from Static Faction, Inc. of Salem, Mass., USA, under the tradename THUNDERON. This material is provided as an adhesive tape, cord, brush, yarn, tow/filament, and "cactus" configuration (individual needles extending from the longitudinal sides of a central web). Although not intending to be limited to any particular operating principle, it is believed that the THUNDERON and other static dissipating materials function by using the high voltage on an object's surface to ionize air molecules and induce a corona discharge in the air surrounding the individual points or "pricks" of the dissipating material. Since the ions are subjected to the electric field concentrated at the points, ions of a polarity opposite to the charge polarity of the object will travel along the electric field lines to the surface, thereby neutralizing the field. The oppositely charged ions are neutralized as they move beyond the ionization region. This process continues until the field has been reduced to the point where ionization of the air ceases. This corona discharge principle is thus a function of the material's ability to induce ionization using the voltage of the charged object. The electrical energy generated during this process is small and insufficient to create a spark.

Thus, as used herein, "static charge dissipating material" refers to any conductive material having a surface resistivity that renders the material electrostatically conductive and permits it to function as described above. The terms "conductive", "antistatic", and "static dissipating" are used interchangeably in the art to refer to such materials. Generally, suitable static dissipating materials have a surface resistivity of less than $10^{14}$ ohms/square. The THUNDERON Tape Brush from Static Faction, Inc. has a surface resistivity of between $1.5\text{-}3.0\times10^{2}$ ohms/square.

Figure 6A:
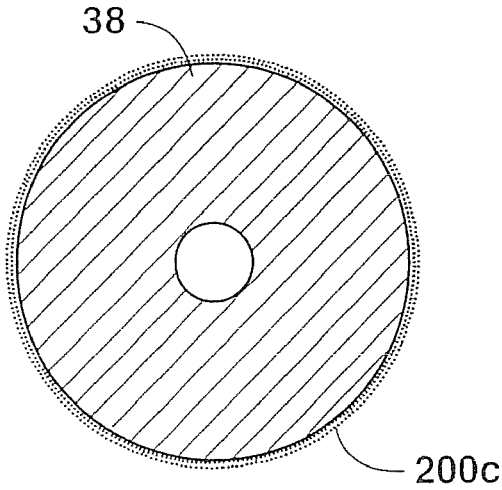
FIGS. 6A and 6B are different cut-away views of a drive roller incorporating a static charge dissipating material.

The static dissipating materials 200*a-f* are "passive" and "self-discharging" in that they are not supplied with power or otherwise externally excited to function, unlike conventional ionization bars. The materials may be applied with adhesives or other conventional means to any surface within the dispenser 10 that accumulates a static charge, such as surfaces that contact the web material as it travels through the dispenser in a dispense sequence. For example, FIG. 5 illustrates static charge dissipating material 200*f* applied to a section of the module 28 defining a guide surface in the throat section 24 of the dispenser along which the web material 120 slides. FIG. 6A illustrates the surface of the drive roller 38 covered with a tape of dissipating material 200*c*, such as the THUNDERON tape material from Static Faction, Inc., discussed above.

It is also within the scope of the invention to incorporate static dissipating material as a coating on any one or combination of the dispenser components. or example, the material 200*c* on the drive roller 38 in FIG. 6A may be a coating applied directly to the surface of the roller. A number of materials are known in the art for this purpose. For example, quaternary ammonium salts and fatty acid derivatives (i.e., carboxylic acids with long carbon chains) are know antistatic coating compounds. Highly conductive coatings containing metal or carbon black are also suitable as static dissipating materials.

Figure 6B:
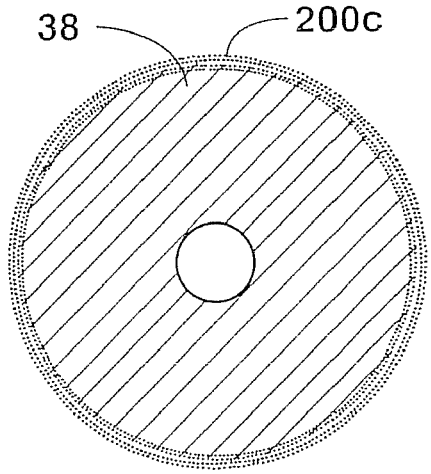

In other embodiments, the static dissipating material may be incorporated as an integral part of the component's composition. For example, the dispenser housing 18, module 28, and various components of the dispensing mechanism may be formed of molded polymeric materials that are, by nature, insulating materials and prone to the build-up of static charge when subjected to frictional forces, such as the web material sliding against such surfaces. These components may be rendered at least partially antistatic by directly blending antistatic agents with the polymeric resins during the compounding process. FIG. 6B illustrates an embodiment of a drive roller 38 incorporating the static dissipating material 200*c* as a component of the polymer composition used to make at least the outer portion or a component of the roll 38. A number of commercial antistatic agents are available for this purpose, including, for example, PELESTAT from Sanyo Chemical and IRGASTAT from CIBA Specialty Chemicals.

It should thus be appreciated that any suitable material that can be either melt-processed into the polymeric composition or sprayed or otherwise applied onto the polymeric component to improve surface conductivity may be used. Typical, monomeric antistatic agents are glycerol monostearate, glycerol distearate, glycerol tristearate, ethoxylated amines, primary, secondary and tertiary amines, ethoxylated alcohols, alkyl sulfates, alkylarylsulfates, alkylphosphates, alkylaminesulfates, quaternary ammonium salts, quaternary ammonium resins, imidazoline derivatives, sorbitan esters, ethanolamides, betaines and mixtures of the foregoing. Typical polymeric antistatic polymers are: copolyesteramides, polyether-polyamides, polyetheramide block copolymers, polyetheresteramide block copolymers, polyurethanes containing a polyalkylene glycol moiety, polyetheresters and mixtures thereof. Polymeric antistatic materials are desirable since they are typically fairly thermally stable and processable in the melt state in their neat form or in blends with other polymeric resins. The polyetheramides, polyetheresters and polyetheresteramides include block copolymers and grail copolymers both of which are obtained by the reaction between a polyamide-forming compound and/or a polyester-forming compound, and a compound containing a polyalkylene oxide unit. Polyamide forming compounds include aminocarboxylic acids such as .omega.-aminocaproic acid, .omega.-aminoenanthic acid, .omega.-aminocaplylic acid, .omega.-aminopelargonic acid, .omega.-aminocapric acid, 1,1-aminoundecanoic acid and 1,2-aminododecanoic acid; lactams such as .epsilon.-caprolactam and enanthlactam; a salt of a diamine with a dicarboxylic acid, such as hexamethylene diamine adipate, hexamethylene diamine sebacate, and hexamethylene diamine isophthalate; and a mixture of these polyamide-forming compounds. A desirable polyamide-forming compounds are caprolactam, 1,2-aminododecanoic acid, or a combination of hexamethylene diamine and adipate.

It should be appreciated by those skilled in the art that various modifications and variations may be made to features of the dispenser described herein, particularly to the mechanical and control circuitry aspects of the dispenser, without departing from the scope and spirit of the invention. It is intended that the invention include all such variations.

What is claimed is:

1. An electronic dispenser for dispensing a measured sheet from a roll of web material, comprising:

a housing having an internal volume so as to retain at least one roll of web material therein;

an electronically powered dispensing mechanism contained within said housing for dispensing a measured sheet from the roll of web material upon actuation of said dispensing mechanism;

a passive, self-discharging static charge dissipating material incorporated with at least one internal component within said internal volume of said housing that stores static charge generated by operation of said dispenser; and wherein said internal component is a thermally molded polymer component, said static charge dissipating material comprising an antistatic agent directly blended into the melt state of a polymer composition used to form said component so as to form a homogenously dispersed component of said polymer composition.

2. The dispenser as in claim 1, wherein said static charge dissipating material is incorporated with a plurality of different components within said internal volume of said housing.

3. The dispenser as in claim 1, wherein said static charge dissipating material is incorporated with a component along which the web material runs in its conveying path through said dispenser.

4. The dispenser as in claim 3, wherein said static charge dissipating material is incorporated with a throat portion of said dispenser along which the web material slides as it is dispensed from said dispenser.

5. The dispenser as in claim 1, wherein said static charge dissipating material is incorporated with a tear bar against which the web material is contacted to separate the web material into a sheet.

6. The dispenser as in claim 1, wherein said static charge dissipating material is incorporated with a drive roller component of said dispensing mechanism.

7. The dispenser as in claim 1, wherein said static charge dissipating material is incorporated with a pressure roller component of said dispensing mechanism.

8. The dispenser as in claim 1, wherein said static charge dissipating material is applied to a web fuel gauge bar that contacts the roll of web material.

9. The dispenser as in claim 1, wherein said dispenser is configured as an automatic towel dispenser.

10. The dispenser as in claim 1, wherein said dispenser is configured as a toilet tissue dispenser.

* * * * *